US007987602B2

(12) United States Patent
Kanemoto et al.

(10) Patent No.: US 7,987,602 B2
(45) Date of Patent: Aug. 2, 2011

(54) SAFETY CUTTER APPARATUS

(75) Inventors: Glen Kanemoto, Costa Mesa, CA (US); John Andrew Duval, Long Beach, CA (US)

(73) Assignee: Pacific Handy Cutter, Inc., Costa Mesa, CA (US)

( * ) Notice: Subject to any disclaimer, the term of this patent is extended or adjusted under 35 U.S.C. 154(b) by 684 days.

(21) Appl. No.: 11/872,022

(22) Filed: Oct. 14, 2007

(65) Prior Publication Data

US 2009/0094840 A1 Apr. 16, 2009

(51) Int. Cl.

| | |
|---|---|
| ***B26B 1/08*** | (2006.01) |
| ***B26B 1/00*** | (2006.01) |
| ***B26B 11/00*** | (2006.01) |
| ***F41B 13/02*** | (2006.01) |

(52) U.S. Cl. ..... 30/162; 30/335; 30/152; 30/160

(58) Field of Classification Search ..... 30/162, 30/2, 125, 331, 320, 335, 339, 155, 142, 30/160, 159; 7/148, 158, 118, 163, 164; 81/44, 487, 488, 489, 177.2

See application file for complete search history.

(56) References Cited

U.S. PATENT DOCUMENTS

| | | | | |
|---|---|---|---|---|
| 5,023,996 | A | 6/1991 | Pape et al. | |
| 5,207,696 | A * | 5/1993 | Matwijcow | 606/167 |
| 5,230,152 | A * | 7/1993 | Kennedy | 30/162 |
| 5,251,379 | A | 10/1993 | Kuo | |
| 5,313,376 | A | 5/1994 | McIntosh | |
| 5,386,632 | A | 2/1995 | Schmidt | |
| 5,513,405 | A * | 5/1996 | Bradbury et al. | 7/158 |
| 5,613,300 | A | 3/1997 | Schmidt | |
| 5,890,290 | A | 4/1999 | Davis | |
| 5,890,294 | A | 4/1999 | Keklak et al. | |
| 5,964,132 | A | 10/1999 | Chen | |
| 6,286,745 | B1 | 9/2001 | Ackeret | |
| 6,357,120 | B1 | 3/2002 | Khachatoorian et al. | |
| 6,389,625 | B1 | 5/2002 | Rivera | |
| 6,415,514 | B1 | 7/2002 | Chun | |
| 6,708,410 | B2 | 3/2004 | Okada | |
| 7,131,204 | B2 | 11/2006 | Brown et al. | |
| 7,305,770 | B2 | 12/2007 | Critelli et al. | |
| 7,591,072 | B2 | 9/2009 | Stravitz | |
| 2005/0022390 | A1 * | 2/2005 | Whitemiller et al. | 30/144 |
| 2005/0193568 | A1 | 9/2005 | Peyrot et al. | |

(Continued)

FOREIGN PATENT DOCUMENTS

WO WO 2005/090012 A1 9/2005

OTHER PUBLICATIONS

PCT International Application No. PCT/US2008/079749, filed on Oct. 13, 2008 (complete file history through International Search Report and Written Opinion mailed on Dec. 3, 2008).

(Continued)

*Primary Examiner* — Ghassem Alie

(74) *Attorney, Agent, or Firm* — Henricks, Slavin & Holmes LLP

(57) ABSTRACT

A cutter apparatus includes a housing, multiple tools mechanically coupled to the housing, at least one of the tools including a cutting device, and a slider and lock wheel mechanically coupled to the housing and configured to selectively release only one of the tools at a time from being secured within the housing.

22 Claims, 25 Drawing Sheets

U.S. PATENT DOCUMENTS

| | | | | |
|---|---|---|---|---|
| 2006/0080842 | A1 | 4/2006 | Schmidt | |
| 2007/0056170 | A1* | 3/2007 | Rowlay | 30/162 |
| 2008/0086895 | A1 | 4/2008 | Parks | |
| 2008/0110027 | A1* | 5/2008 | Seber et al. | 30/152 |
| 2009/0266210 | A1 | 10/2009 | Chung et al. | |

OTHER PUBLICATIONS

PCT International Application No. PCT/US2009/041979, filed on Apr. 28, 2009 (complete file history through International Search Report and Written Opinion mailed on Jun. 22, 2009).

* cited by examiner

OIL HERE
TAPE SPLIT
THUMB HERE
100
102
106
108
110
112
114
116
130

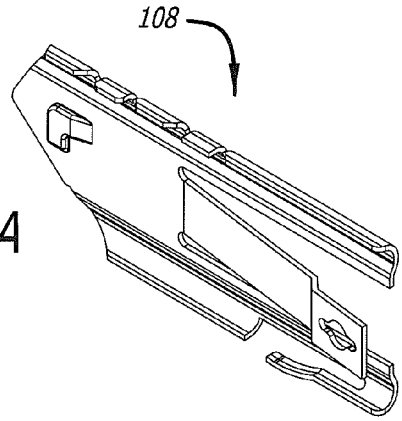
FIG. 19A
FIG. 19C
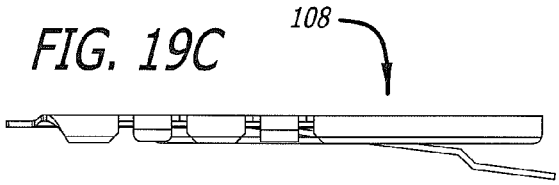
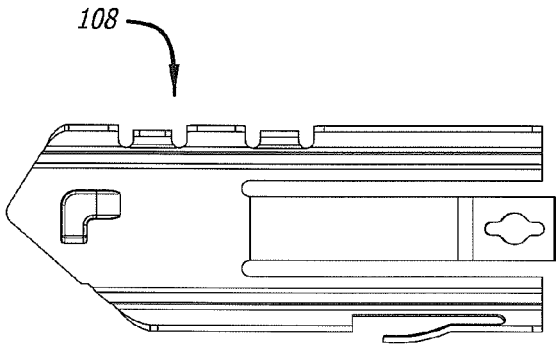
FIG. 19B
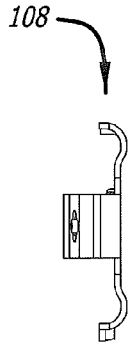
FIG. 19D

FIG. 22A
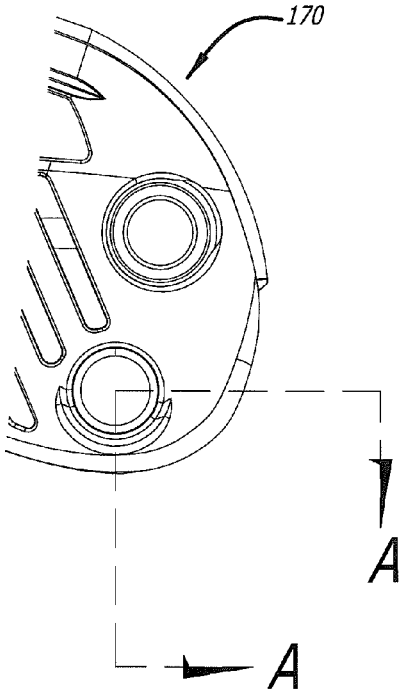
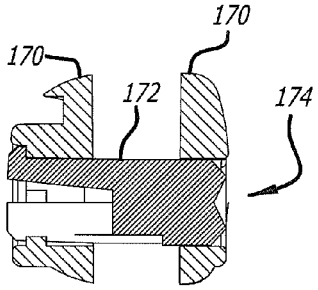
FIG. 22B
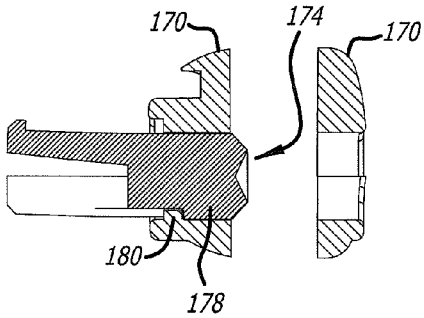
FIG. 22C

SAFETY CUTTER APPARATUS

TECHNICAL FIELD

The invention relates generally to cutters and, in particular, to a safety cutter apparatus.

BACKGROUND ART

A variety of cutting devices with retractable blades are known. Additionally, devices with multiple blades or other tools are known. However, many such devices include cumbersome mechanisms for extending and/or retracting the blades or other tools. Moreover, in the case of devices with multiple blades or other tools, a potential safety hazard may be presented when more than one of the blades or other tools are extended at the same time.

It would be useful to be able to provide a cutter apparatus which addresses one or more of the above concerns.

SUMMARY OF THE INVENTION

In an example embodiment, a cutter apparatus includes a housing, multiple tools mechanically coupled to the housing, at least one of the tools including a cutting device, and a slider and lock wheel mechanically coupled to the housing and configured to selectively release only one of the tools at a time from being secured within the housing by the lock wheel.

In an example embodiment, a cutter apparatus includes a housing and multiple tools mechanically coupled to the housing, at least one of the tools including a film cutter that is detachably secured to the housing.

BRIEF DESCRIPTION OF THE DRAWINGS

FIGS. 19A-19D are perspective, front, top, and right side views, respectively, of an example channel for the slider;

FIG. 22A is a partial front view of the example safety cutter showing the retaining pin;

FIG. 22B is a cross-sectional view along A-A of FIG. 22A, showing the retaining pin in a position for retaining the film cutter; and FIG. 22C is a cross-sectional view along A-A of FIG. 22A, showing the retaining pin in a position for releasing the film cutter.

DISCLOSURE OF INVENTION

Figure 1A:
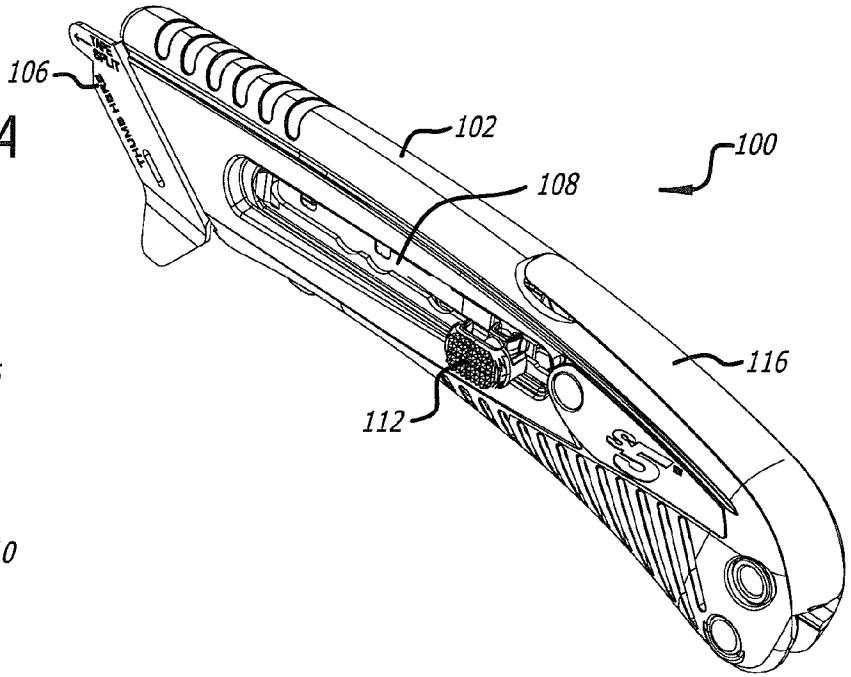
FIGS. 1A and 1B are front and back perspective views, respectively, of an example safety cutter.
Figure 1B:
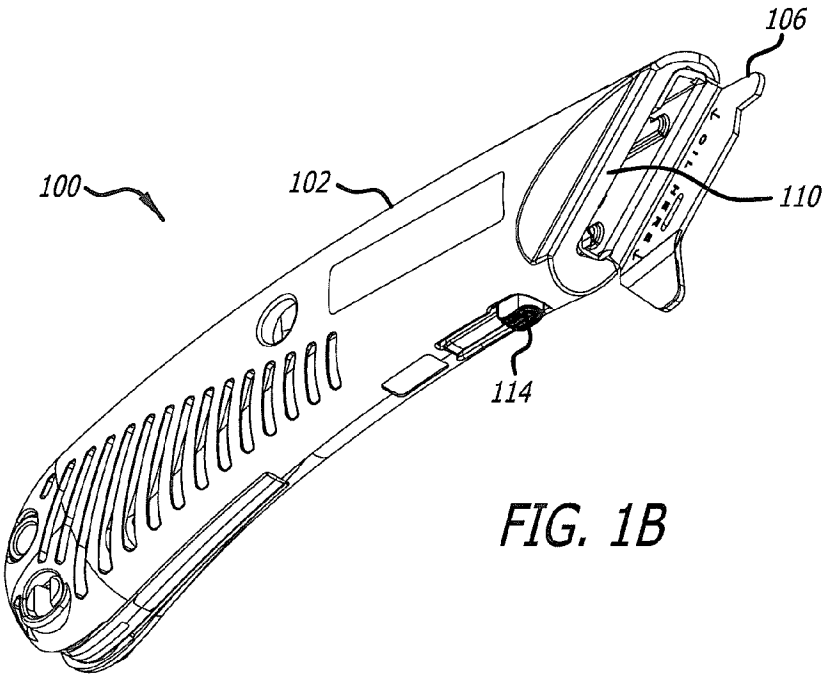
Figures 2A, 2B, 2C, 2D, 2E, 2F:
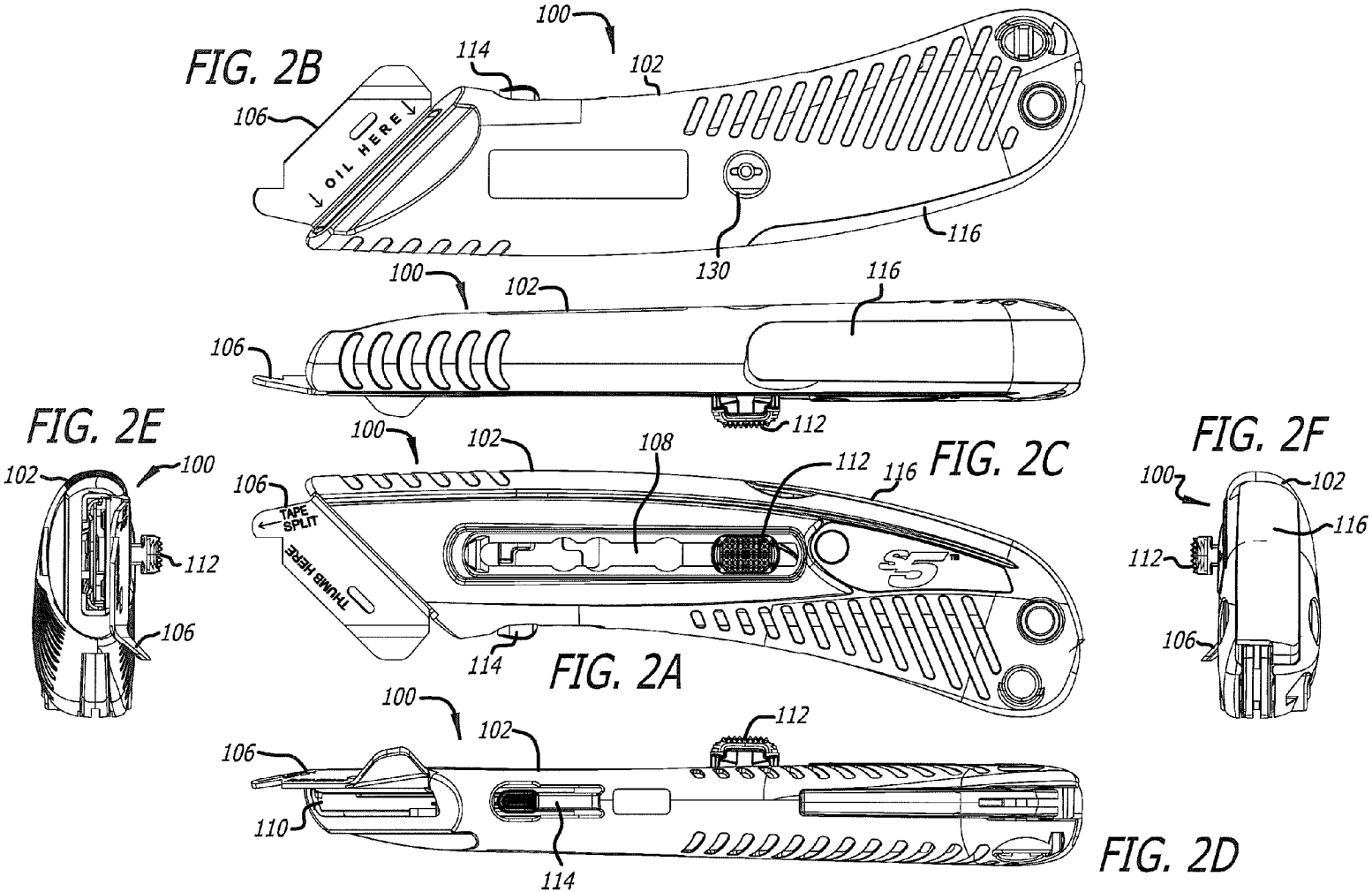
FIGS. 2A-2F are front, back, top, bottom, left, and right side views, respectively, of the example safety cutter.

Referring to FIGS. 1A-2F, in an example embodiment, a cutter apparatus 100 includes a housing 102, a blade 104 (e.g., a box cutter blade), a blade guard 106, and a slider 108. The housing 102 is made out of plastic, for example, and can be shaped as shown or differently. The blade 104 (retracted within the housing 102, in these figures) is conventional. The blade guard 106 (made of metal, for example) is secured to the distal end of the housing 102 as shown, adjacent to an opening 110 from which the blade 104 can be extended. The slider 108 (made of metal, for example) is flexible and mechanically coupled within the housing 102 such that the slider 108 can be manipulated in position forward or backward along the length of the housing 102, unless the cutter apparatus 100 is in a "blade lock mode" (discussed below).

Figure 3B:
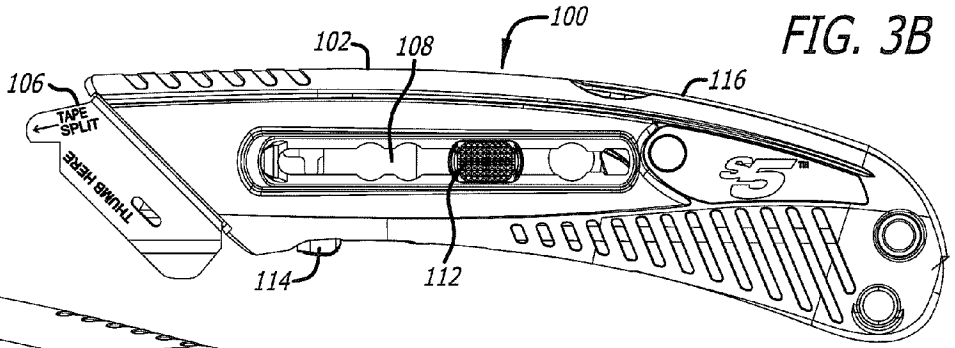
FIGS. 3A-3C are perspective, front, and back side views, respectively, of the example safety cutter with its box cutter blade shown in a partially extended position.
Figure 3A:
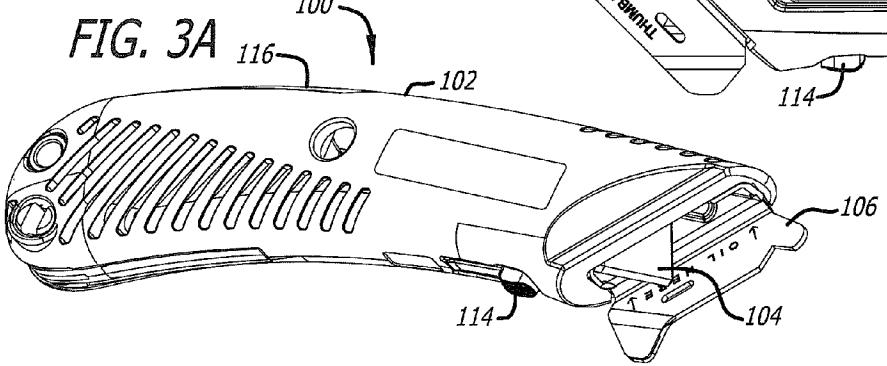
Figure 3C:
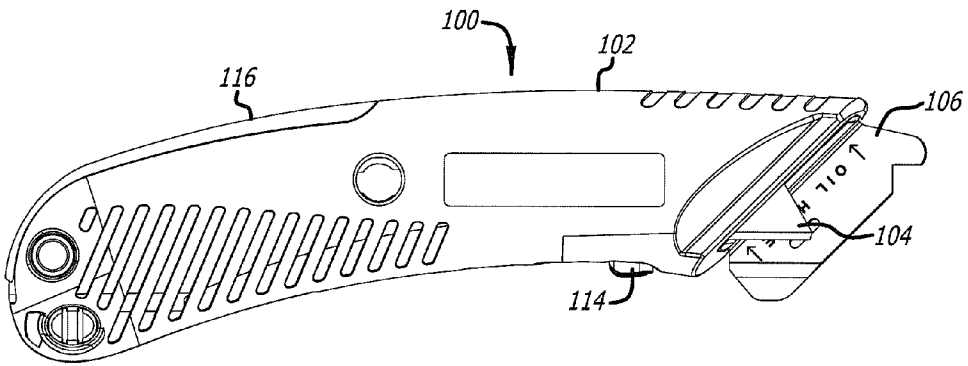
Figure 4B:
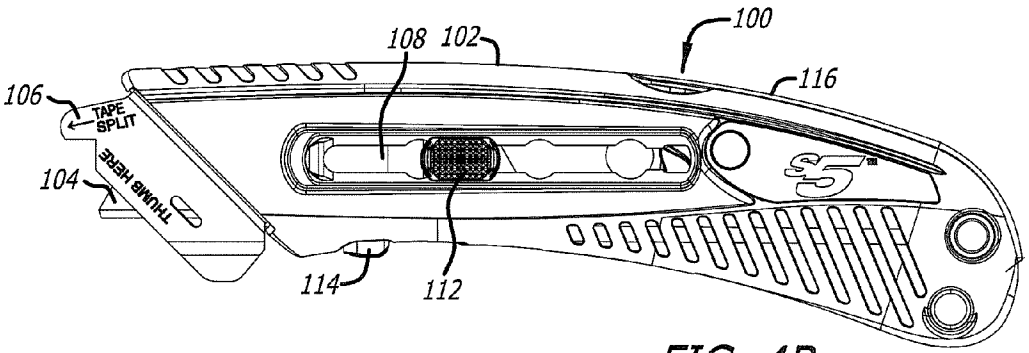
FIGS. 4A-4C are perspective, front, and back side views, respectively, of the example safety cutter with its box cutter blade shown in a further extended position.
Figure 4A:
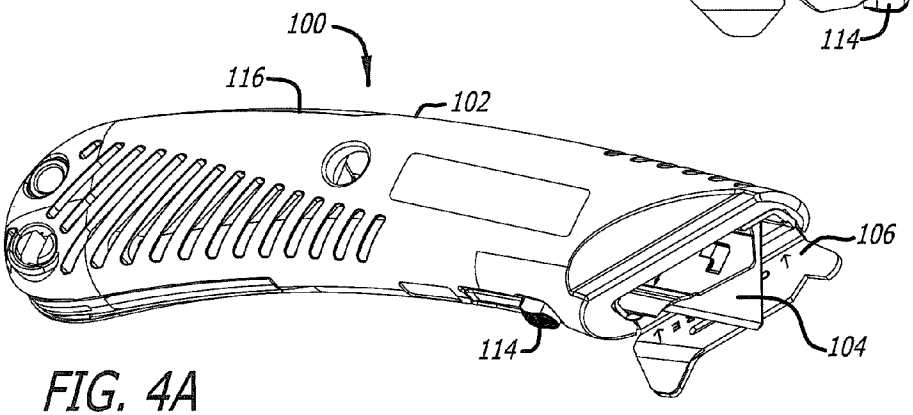
Figure 4C:
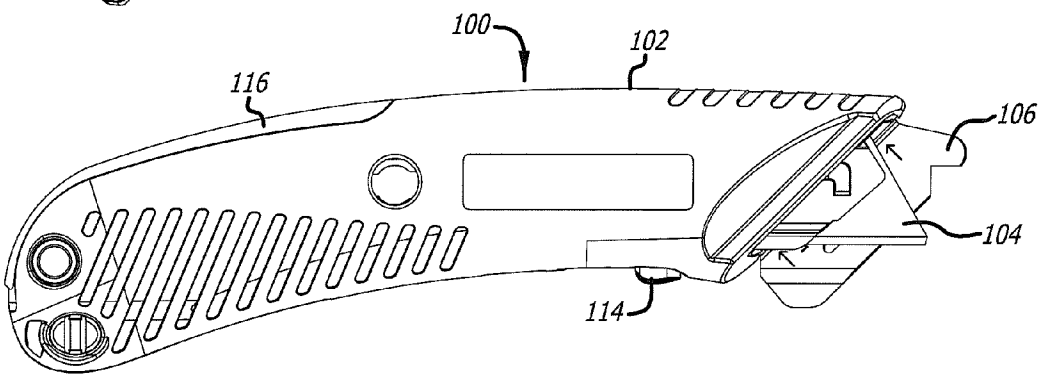
Figure 5B:
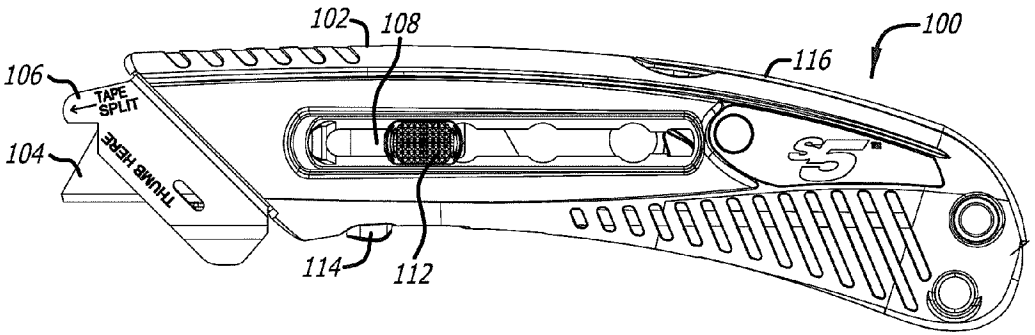
FIGS. 5A-5C are perspective, front, and back side views, respectively, of the example safety cutter with its box cutter blade shown in a still further extended position.
Figure 5A:
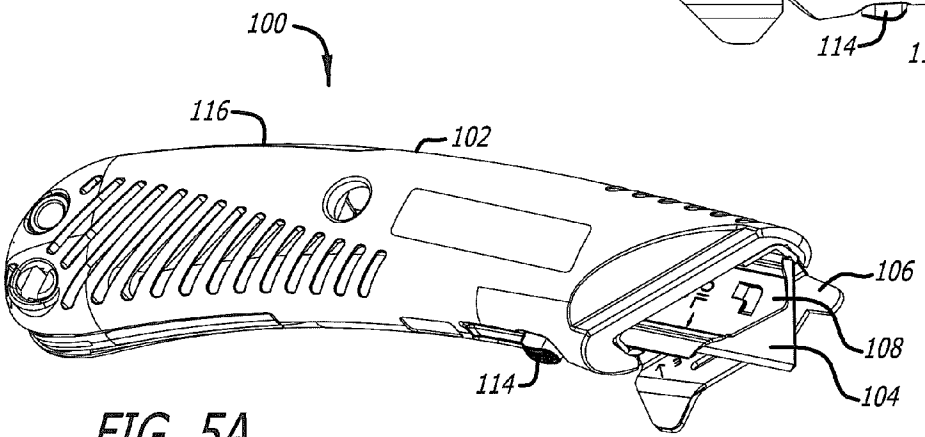
Figure 5C:
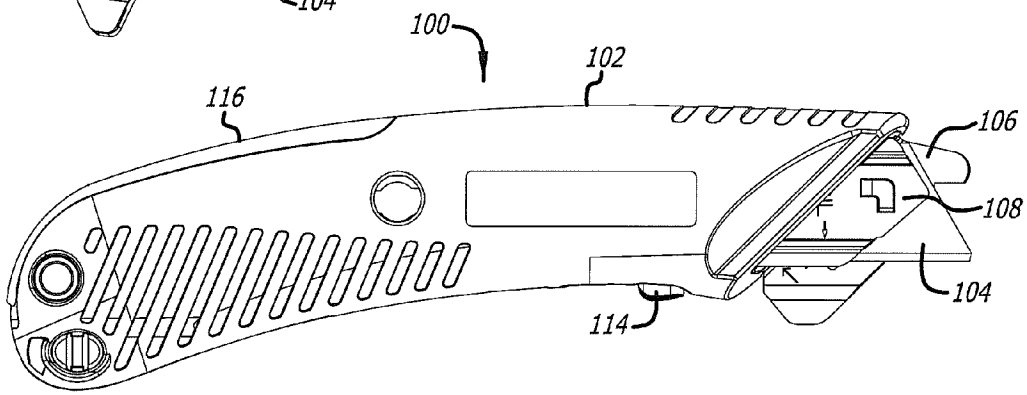
Figure 6B:
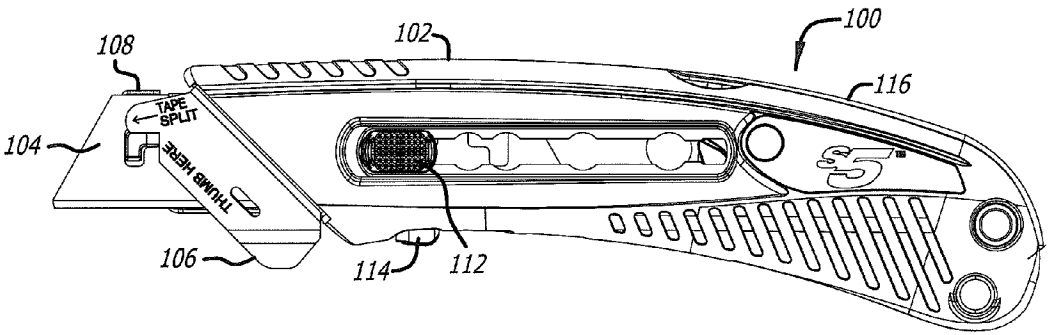
FIGS. 6A-6C are perspective, front, and back side views, respectively, of the example safety cutter with its box cutter blade shown in a fully extended position.
Figure 6A:
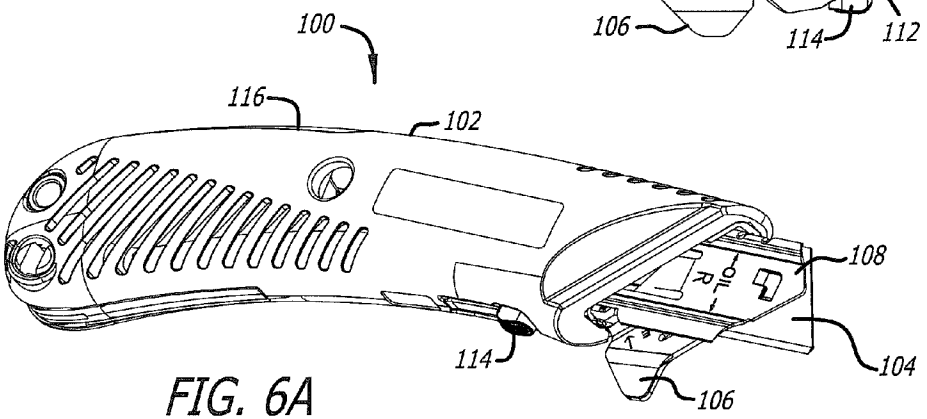
Figure 6C:
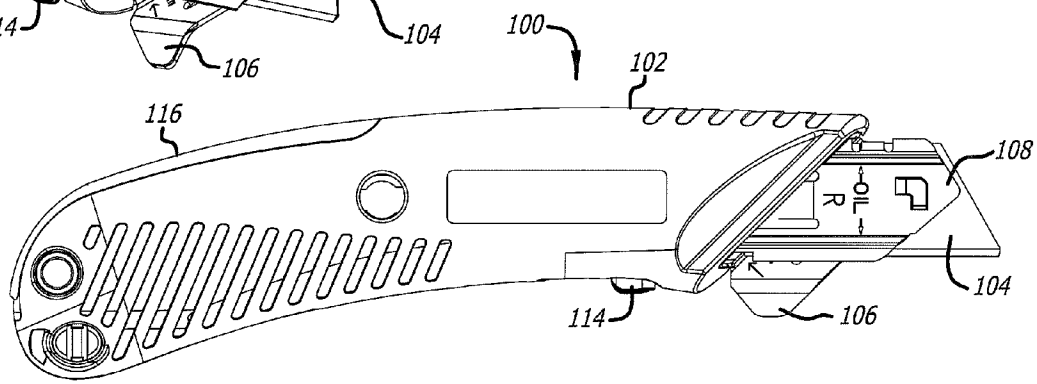
Figure 7A:
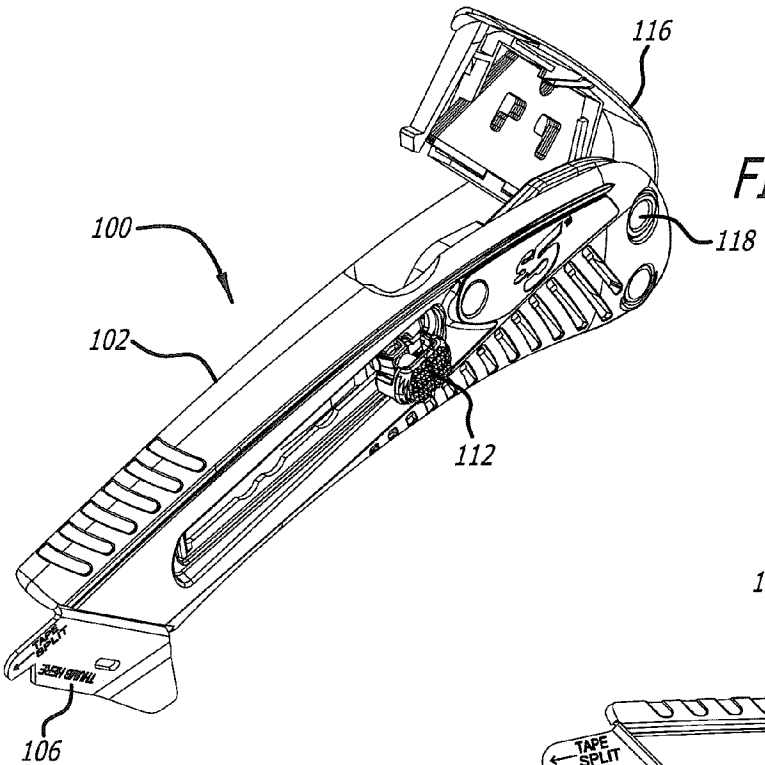
FIGS. 7A and 7B are perspective and front side views, respectively, of the example safety cutter with its spare blade carrier shown in an extended position.
Figure 7B:
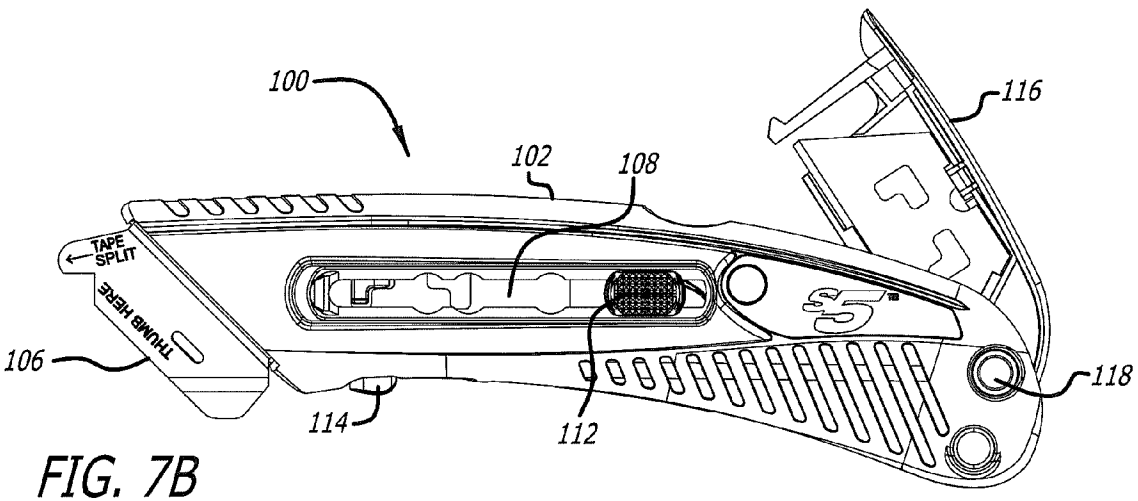
Figure 8A:
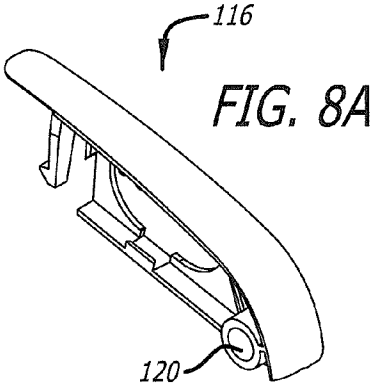
FIGS. 8A-8H are front perspective, back perspective, front, back, top, bottom, left, and right side views, respectively, of an example spare blade carrier.
Figure 8H:
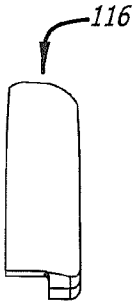
Figure 8D:
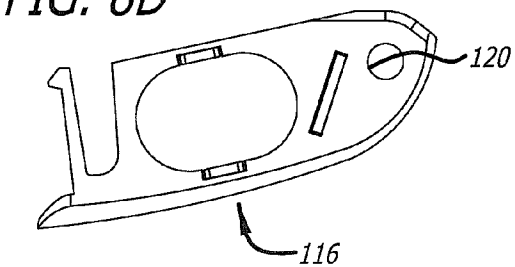
Figure 8E:
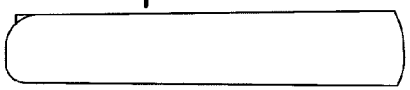
Figure 8C:
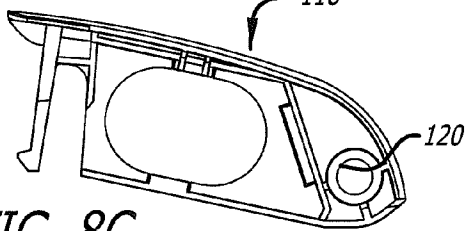
Figure 8F:
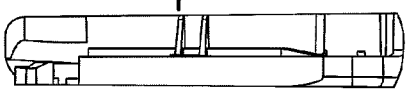
Figure 8B:
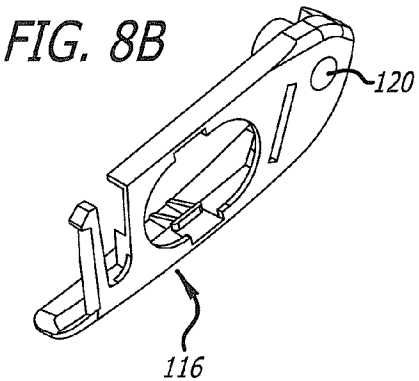
Figure 8G:
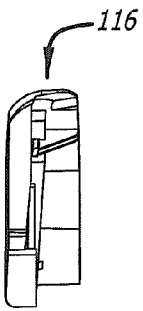

In this example embodiment, the slider 108 includes a button 112, which extends through the housing 102 and can be used to move the slider 108 forward or backward to extend or withdraw the blade 104, respectively. This is illustrated in a sequence of figures. In FIGS. 3A-3C, the blade 104 is shown in a partially extended position. In FIGS. 4A-4C, the blade 104 is shown in a further extended position. In FIGS. 5A-5C, the blade 104 is shown in a still further extended position. In FIGS. 6A-6C, the blade 104 is shown in a fully extended (blade change) position. In this example embodiment, a living hinge 114, as an additional conventional safety feature, must also be depressed inward toward the housing 102 in order for the slider 108 to be allowed to advance to the fully extended (blade change) position.

Referring to FIGS. 7A-8H, the example cutter apparatus 100 also includes a spare blade carrier 116 shown in its extended position. In this example embodiment, the spare blade carrier 116 is shaped to hold several spare blades and is pivotally secured to the housing 102 by a pin 118 that fits through a channel 120 of the spare blade carrier 116. In this example embodiment, the housing 102 includes an indent 122 which permits a user of the cutter apparatus 100 to pivotally reposition the spare blade carrier 116 in relation to the housing 102, independent of the mode of operation of the cutter apparatus 100.

Figure 9A:
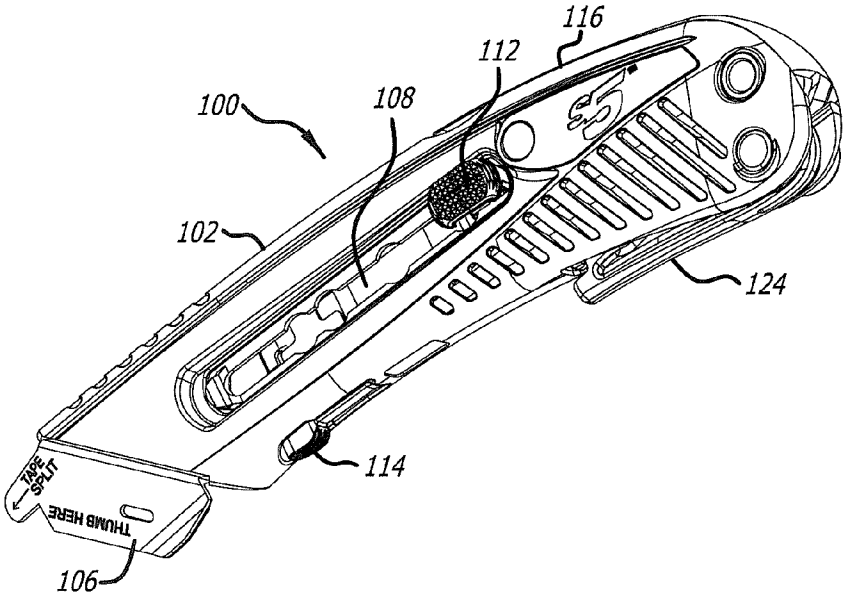
FIGS. 9A and 9B are perspective and front views, respectively, of the example safety cutter with its film cutter shown released from the housing of the safety cutter.
Figure 9B:
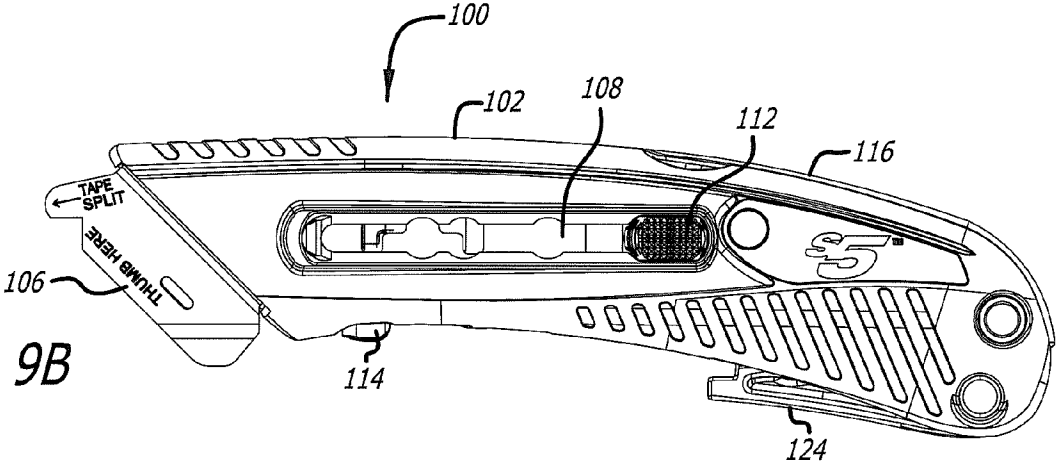
Figure 10A:
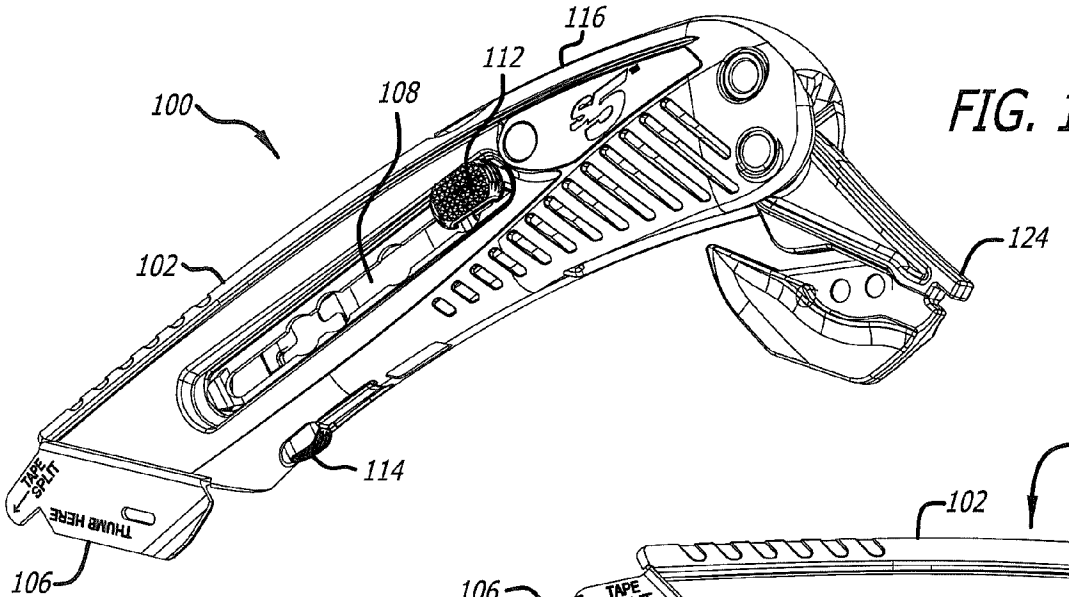
FIGS. 10A and 10B are perspective and front views, respectively, of the example safety cutter with its film cutter shown partially extended from the housing of the safety cutter.
Figure 10B:
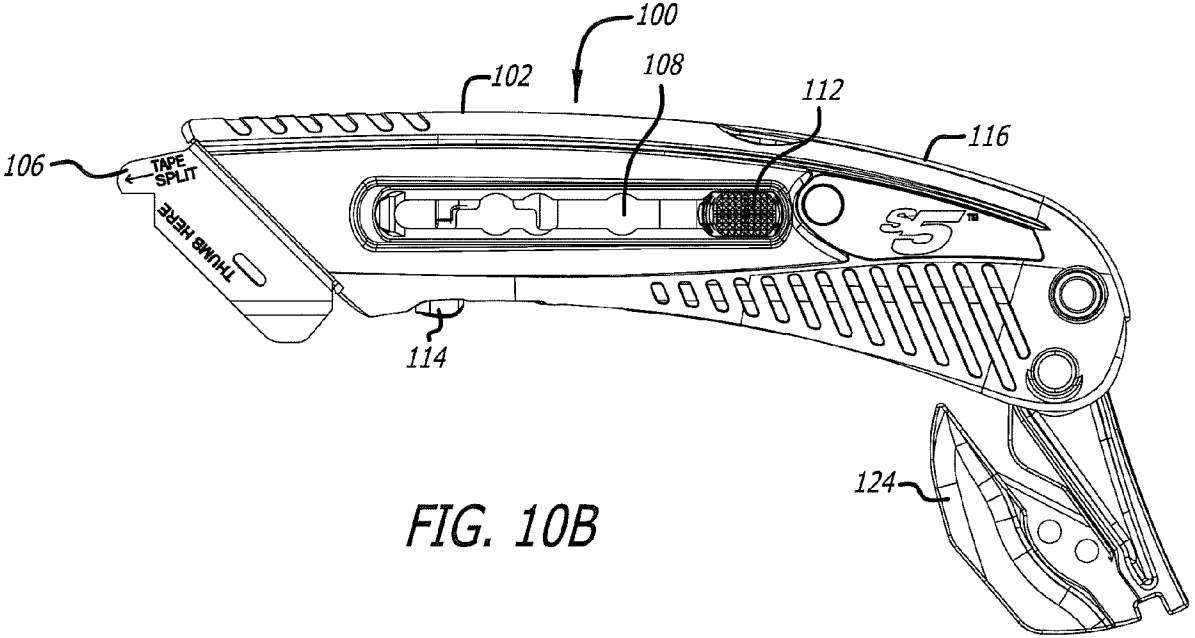
Figure 11A:
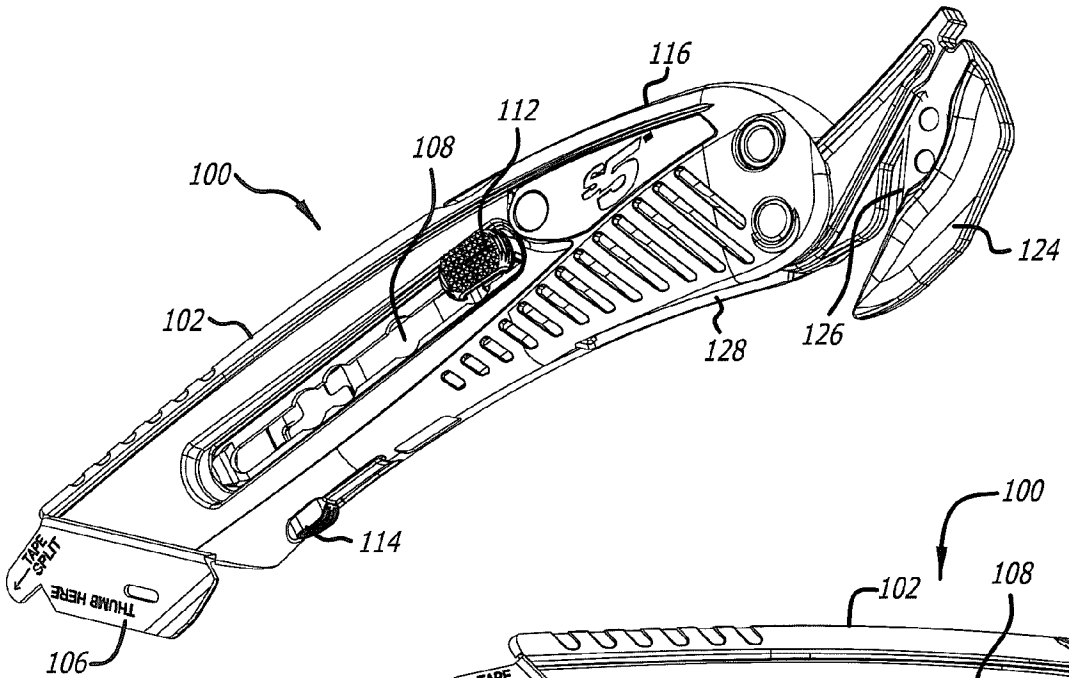
FIGS. 11A and 11B are perspective and front views, respectively, of the example safety cutter with its film cutter shown fully extended from the housing of the safety cutter.
Figure 11B:
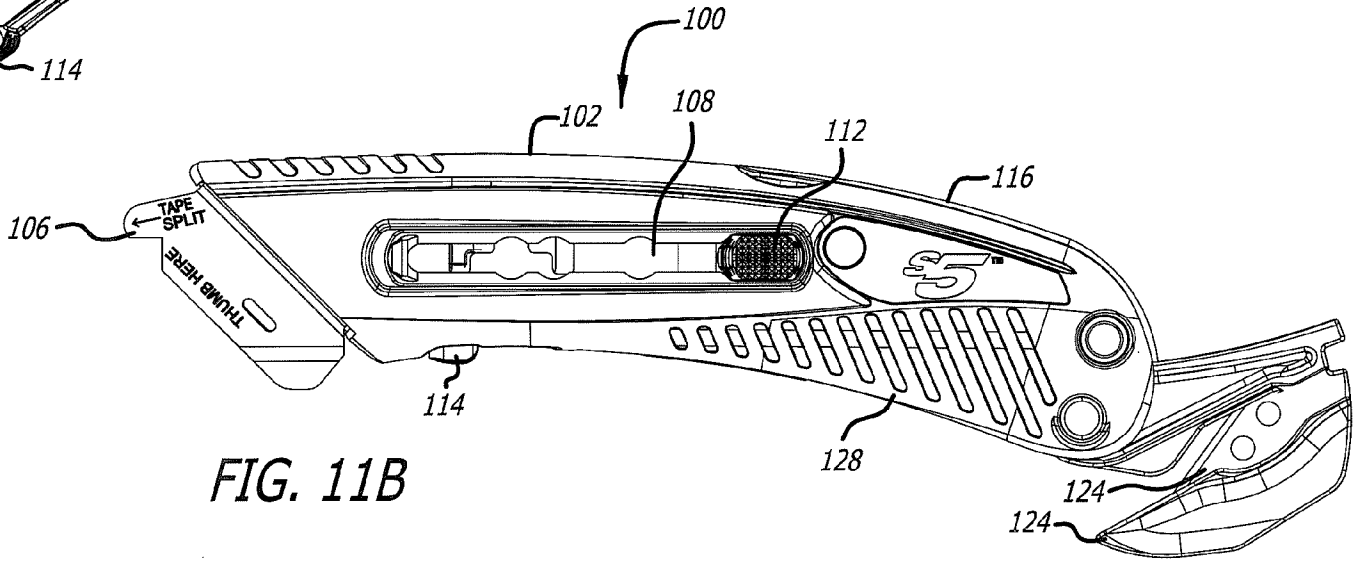

Referring to FIGS. 9A-11B, the example cutter apparatus 100 also includes a film cutter 124 that is pivotally coupled to the housing 102. Movement of the film cutter 124 in relation to the housing 102 is illustrated in a sequence of figures. In FIGS. 9A and 9B, the film cutter 124 is shown released from the housing 102. In FIGS. 10A and 10B, the film cutter 124 is shown partially extended from the housing 102. In FIGS. 11A and 11B, the film cutter 124 is shown fully extended from the housing 102. Thus, the film cutter 124 is mechanically coupled to the housing 102 such that the film cutter 124 is manipulable to an extended position in which a cutting edge 126 of the film cutter 124 faces a bottom side 128 of the housing 102.

In this example embodiment, the spare blade carrier 116 is adjacent to the film cutter 124 when both the spare blade carrier 116 and the film cutter 124 are positioned within the housing 102. In this example embodiment, the housing 102 includes a spare blade viewing hole 130 (FIG. 2B) which faces a portion of the housing 102 adjacent to the end of the spare blade carrier 116 (to provide a window to see if there are any spare blades left) when the spare blade carrier 116 is positioned within the housing 102.

Referring to FIGS. 12A-17H, the example cutter apparatus 100 also includes a lock wheel 132 formed as shown. The slider 108 and the lock wheel 132 are mechanically coupled to the housing and configured to selectively release only one of the tools at a time from being secured within the housing 102. In this example embodiment, the slider 108 (which holds the blade 104) is supported by a slider guide 134 which, in turn, is secured within the inside of the housing 102. In an example embodiment, the slider guide 134 and blade guard 106 are integrally formed.

The lock wheel 132 is mechanically coupled within the housing 102 and repositionable by a user of the cutter apparatus 100 to selectively release only one of the tools at a time from being secured within the housing 102. In this example embodiment, the lock wheel 132 is pivotally secured to the housing 102 by a pin 136 that fits through a channel 138 of the lock wheel 132.

Generally, the button 112 and the lock wheel 132 can be considered to function as an actuator that releases the film cutter 124. It should be appreciated that other structures than those specifically described herein can be employed to implement the aforementioned actuator functionality.

Figure 12A:
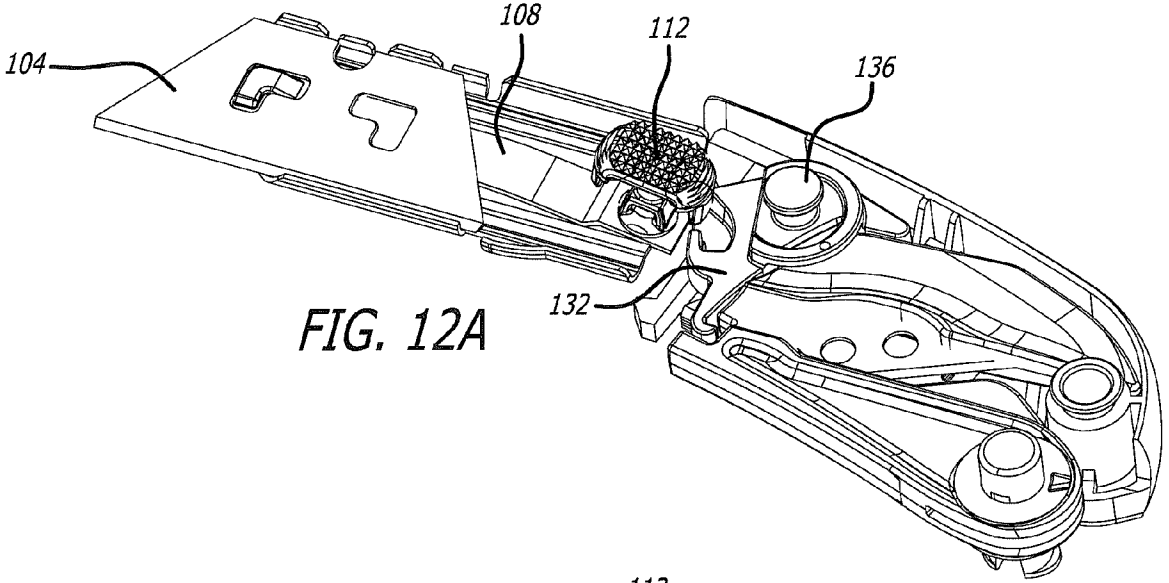
FIGS. 12A and 12B are perspective and front views, respectively, of the example safety cutter (shown with most of the housing removed) illustrating the button of the slider about to engage the lock wheel.
Figure 12B:
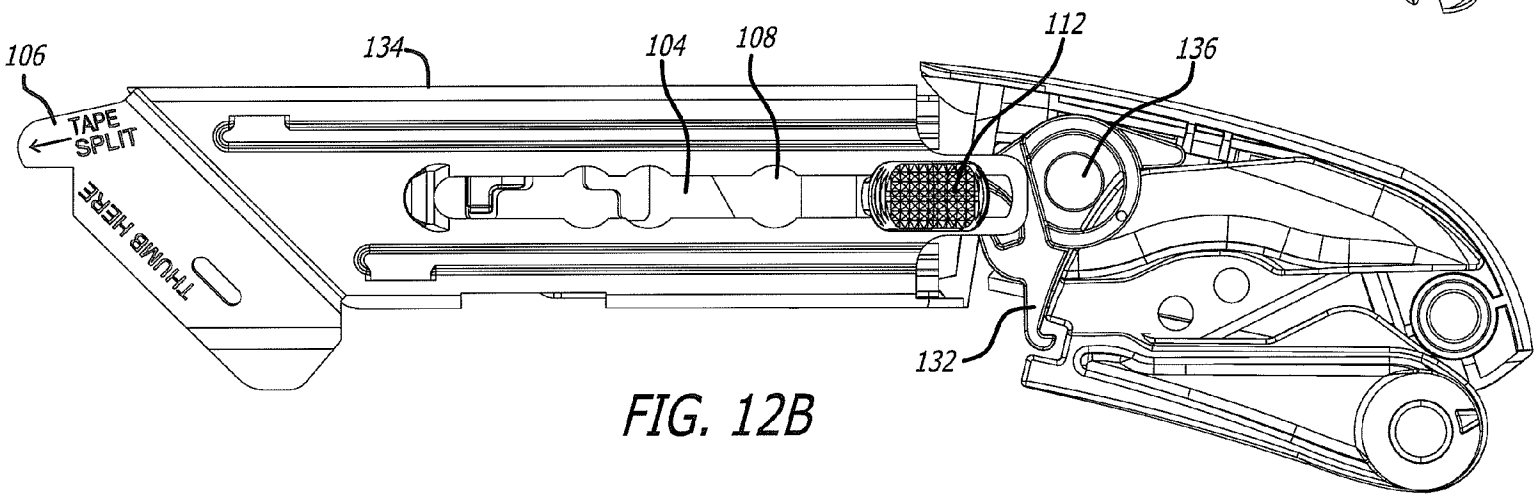
Figure 13A:
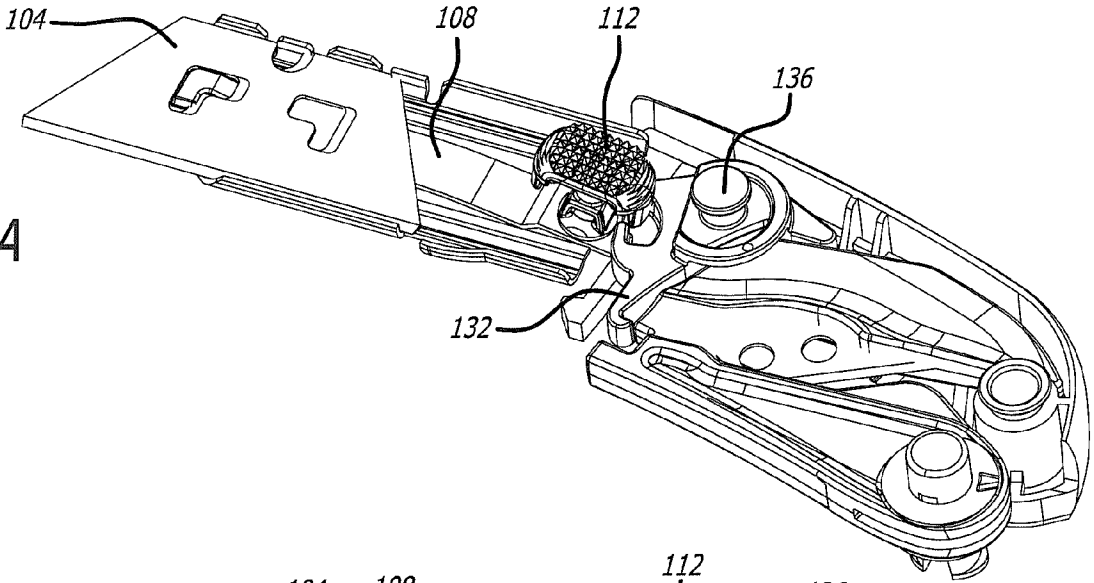
FIGS. 13A and 13B are perspective and front views, respectively, of the example safety cutter (shown with most of the housing removed) illustrating the button of the slider engaging the lock wheel.
Figure 13B:
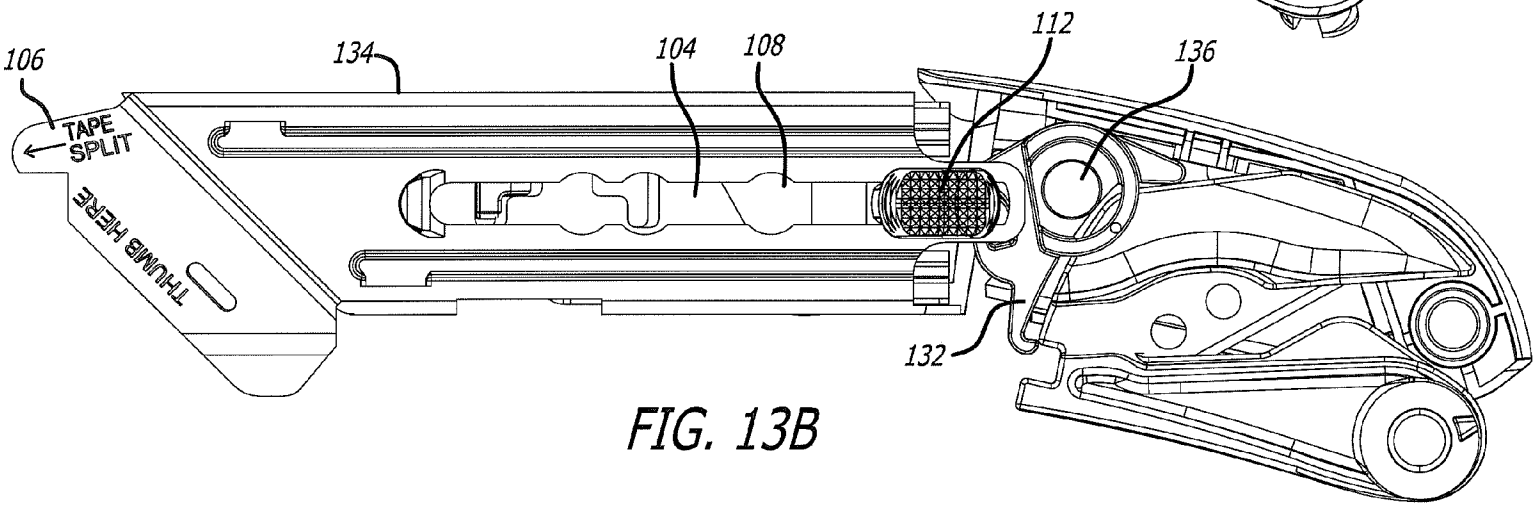
Figure 14A:
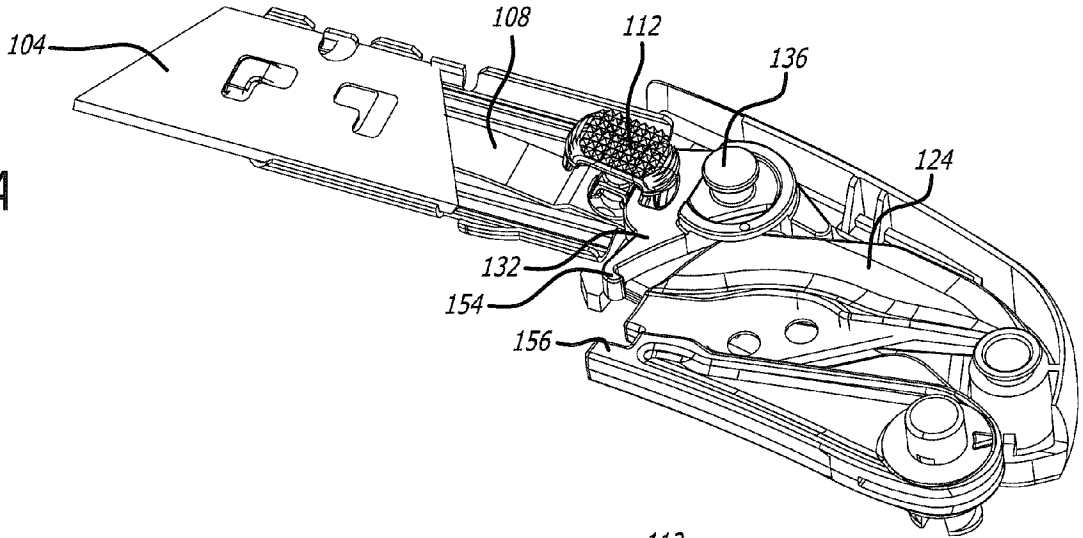
FIGS. 14A and 14B are perspective and front views, respectively, of the example safety cutter (shown with most of the housing removed) illustrating the button of the slider fully engaged with the lock wheel.
Figure 14B:
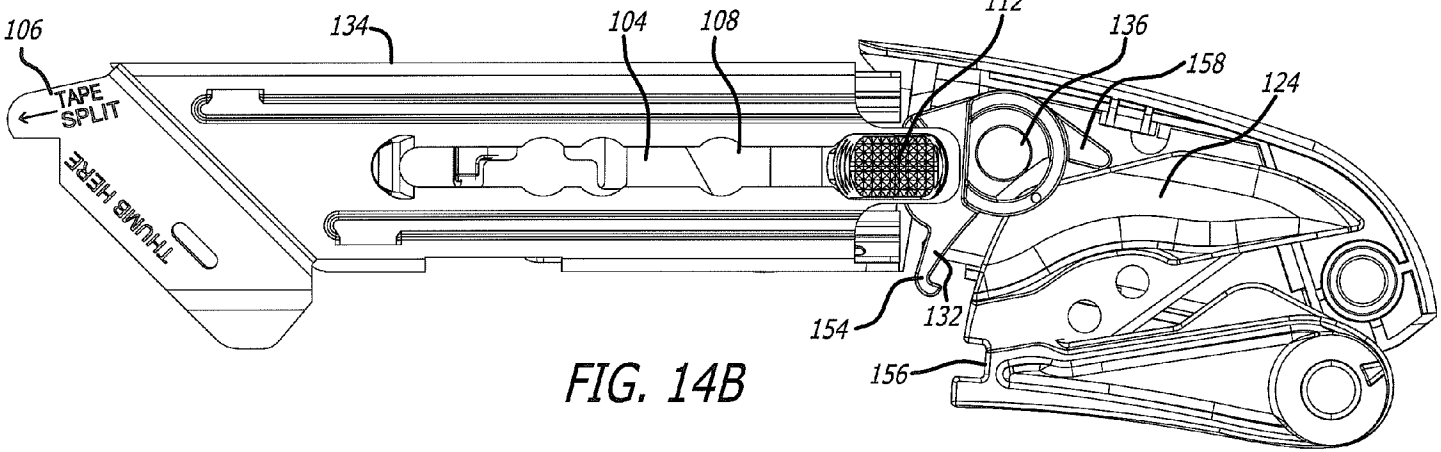

In this example embodiment, the slider 108 (FIGS. 19A-19D) acts as a spring, flexing and allowing (as shown in FIGS. 12A-14B) the button 112 to engage and interlock with the lock wheel 132 thereby releasing the film cutter 124. In FIGS. 12A and 12B, the button 112 is about to engage the lock wheel 132. In FIGS. 13A and 13B, the button 112 is engaging the lock wheel 132. In FIGS. 14A and 14B, the button 112 is fully engaged with the lock wheel 132.

In this example embodiment, the lock wheel 132 includes an aperture 140 (FIG. 17H) formed as shown, and the button 112 includes a hook member 142 (FIGS. 18A-18E) configured to fit within the aperture 140. The example lock wheel 132 includes a quality control inspection mark 144. In this example embodiment, the aperture 140 includes a button entry portion 146, a cam surface 148 with a changeover point 150, and a safety lockout portion 152 (adjacent to which, the hook member 142 is seated when the film cutter 124 is deployed).

The hook member 142 and cam surface 148 are shaped such that the lock wheel 132 is repositioned within the housing 102 toward a film cutter release position (FIGS. 14A and 14B) when the hook member 142 is pushed into the aperture 140 and past the changeover point 150. This repositioning of the lock wheel 132 causes a film cutter locking arm 154 (of the lock wheel 132) to disengage from a notch 156 which is formed in the film cutter 124 as shown. The example lock wheel 132 includes a film cutter deployment member 158 (formed as shown) which is brought into contact with the film cutter 124 when the lock wheel 132 is repositioned to the film cutter release position, by movement of the hook member 142 (of the button 112) across a film cutter deployment ramp 160 (of the aperture 140). The aforementioned contact urges the film cutter 124 to extend slightly from the housing 102 (as shown in FIGS. 14A and 14B), which provides a user of the cutter apparatus 100 with access to the notch 156 of the film cutter 124 so that the film cutter 124 can then be manually withdrawn the remainder of the way to its fully extended position.

In this example embodiment, the cam surface 148 is shaped such that the lock wheel 132 is repositioned within the housing 102 toward a film cutter lock position (FIGS. 12A and 12B) when the hook member 142 is pulled back from before the changeover point 150 toward the button entry portion 146 (of the aperture 140). This relocks the film cutter 124 when the hook member 142 is not pushed past the changeover point 150.

In this example embodiment, the film cutter deployment member 158 includes a high speed ramp 162 and a slow speed ramp 164 formed as shown. The high speed ramp 162 makes contact with the film cutter 124, as described above, to slightly extend the film cutter 124 from the housing 102. The slow speed ramp 164 is shaped such that when the film cutter 124 is folded back into the housing 102 (FIG. 15) the lock wheel 132 is repositioned within the housing 102 bringing a button pop up ramp 166 (of the aperture 140) into contact with the hook member 142 to force the button 112 to pop up and out of the aperture 140 (FIG. 16).

Figure 15:
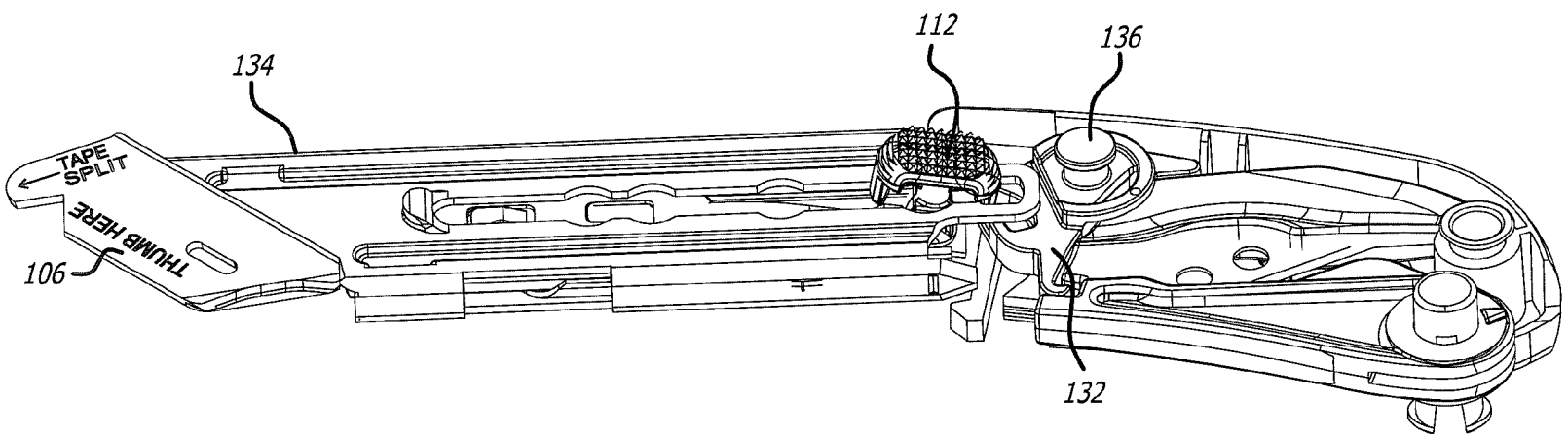
FIG. 15 is a perspective view of the example safety cutter (shown with most of the housing removed) illustrating the button locked in its depressed position (i.e., film cutter mode), with the film cutter being returned to its stored position in order to release the button (to exit the film cutter mode)
Figure 16:
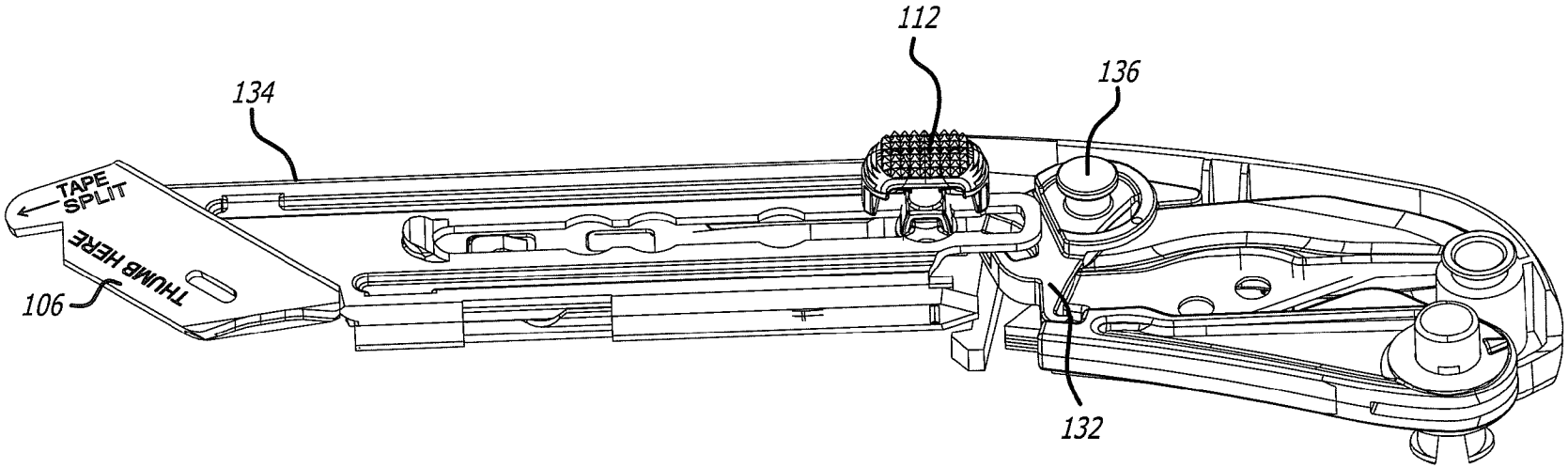
FIG. 16 is a perspective view of the example safety cutter (shown with most of the housing removed) illustrating the button after it has "popped up" (i.e., released from the locked depressed position) as a consequence of the film cutter being pushed back into the housing, thereby exiting from film cutter mode.
Figure 17A:
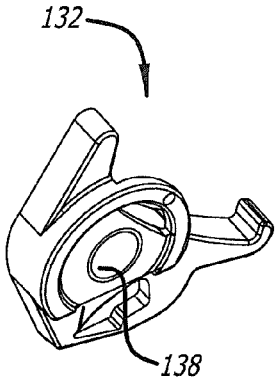
FIGS. 17A-17G are perspective, front, back, top, bottom, left side, and right side views, respectively, of an example lock wheel.
Figure 17D:
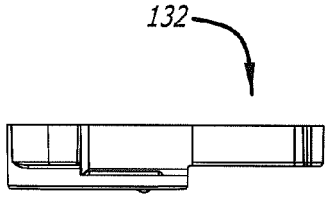
Figure 17C:
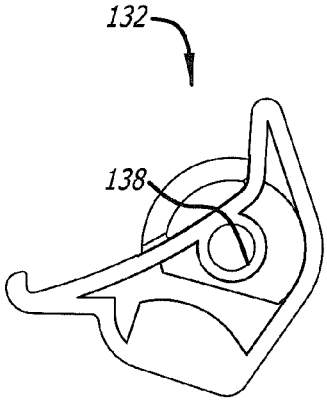
Figure 17F:
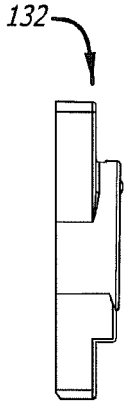
Figure 17B:
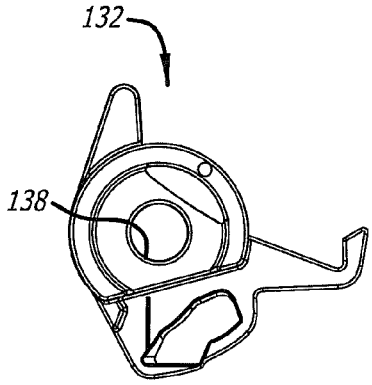
Figure 17G:
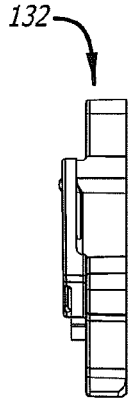
Figure 17E:
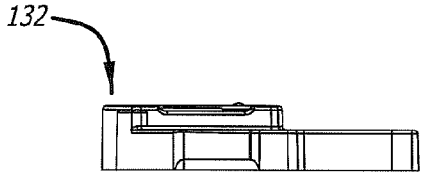
Figure 17H:
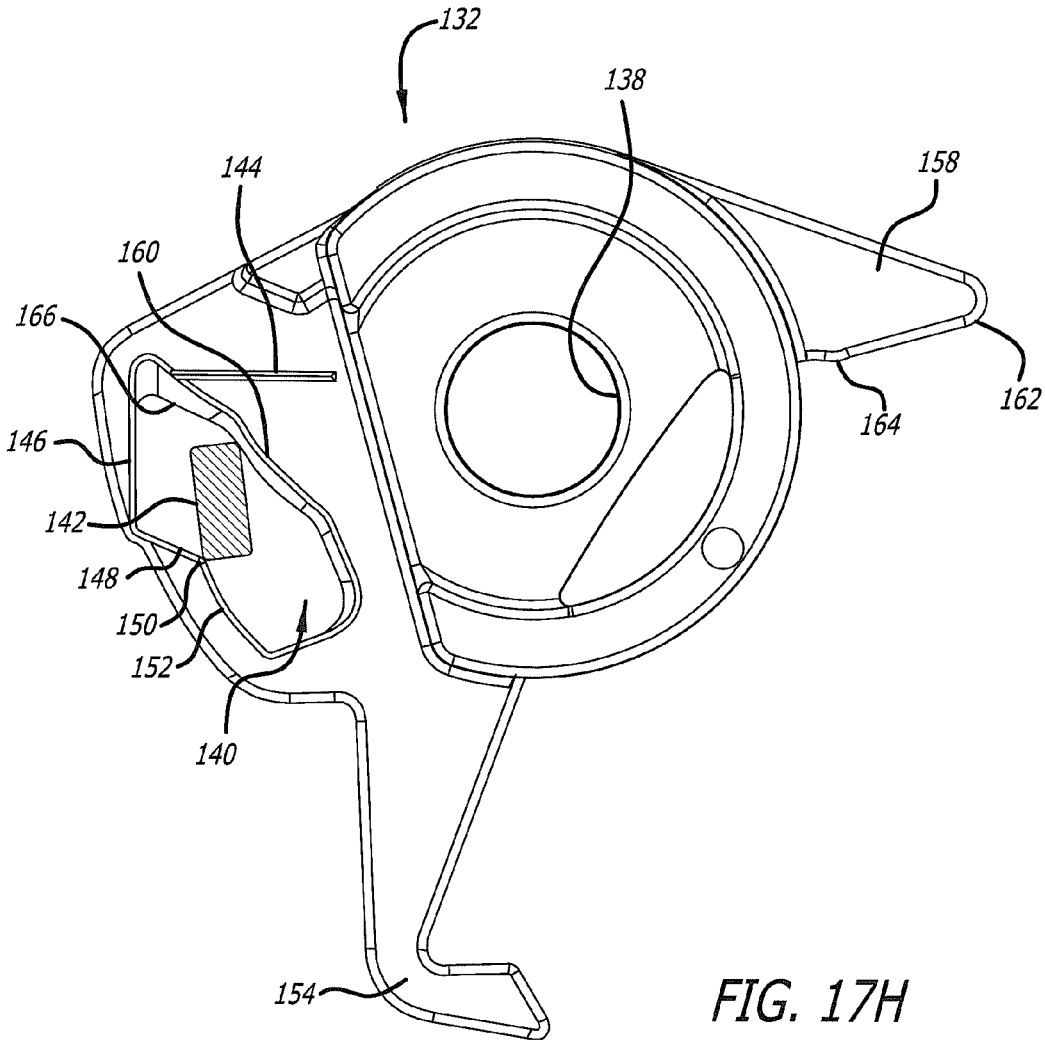
FIG. 17H is an enlarged front view of the example lock wheel.
Figure 18C:
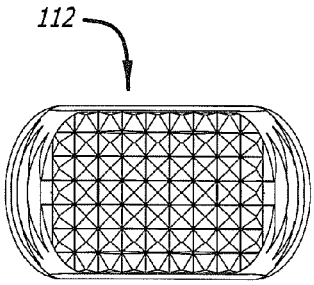
FIGS. 18A-18E are perspective, front, top, bottom, and side views, respectively, of an example button for the slider.
Figure 18A:
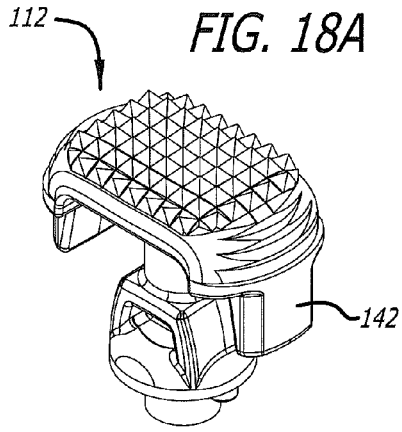
Figure 18B:
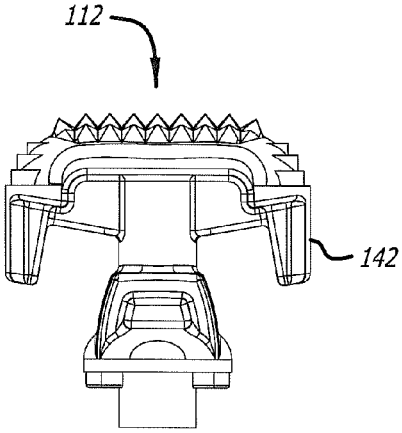
Figure 18E:
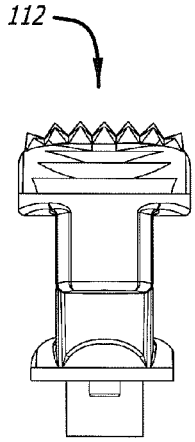
Figure 18D:
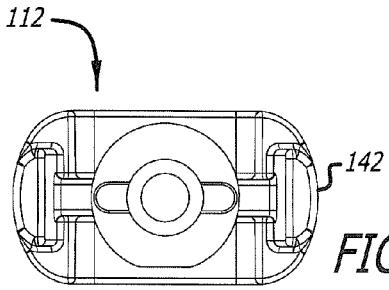
Figure 20A:
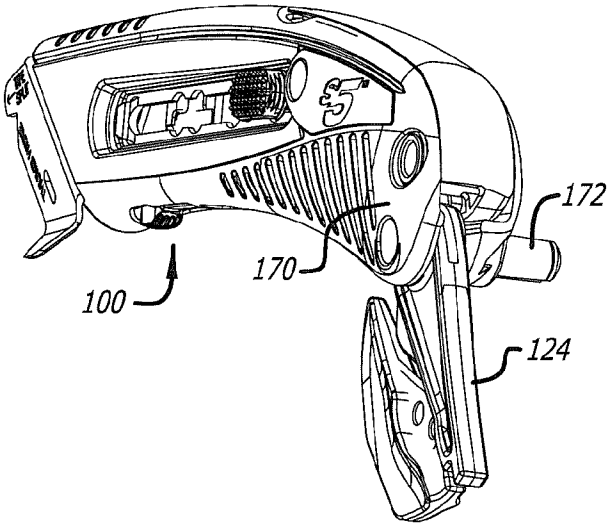
FIGS. 20A-20D are perspective, front, bottom, and right side views, respectively, of the example safety cutter with the retaining pin partially withdrawn from the housing.
Figure 20B:
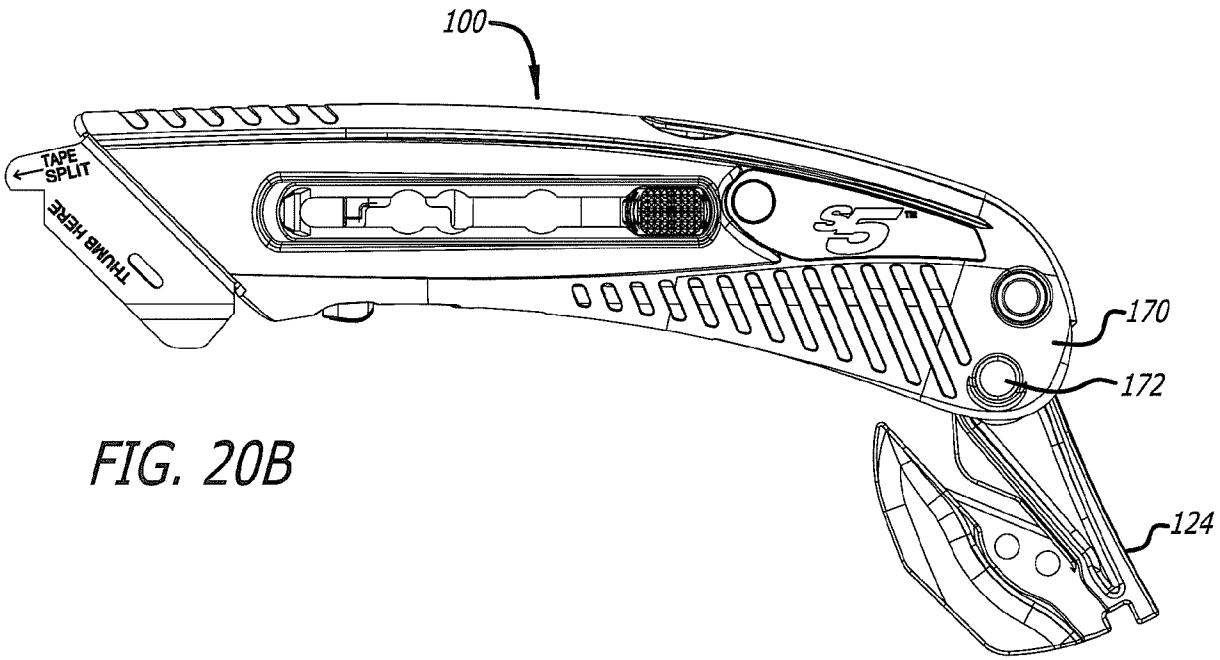
Figure 20D:
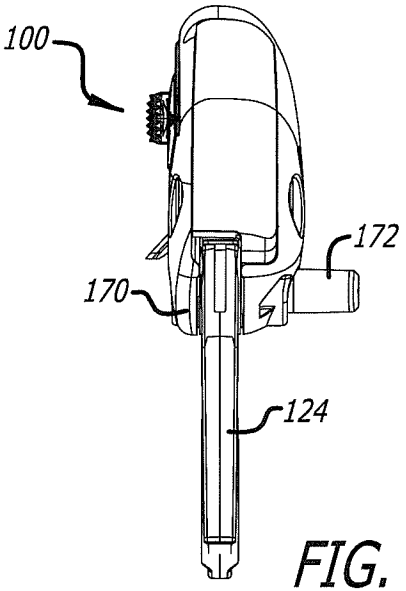
Figure 20C:
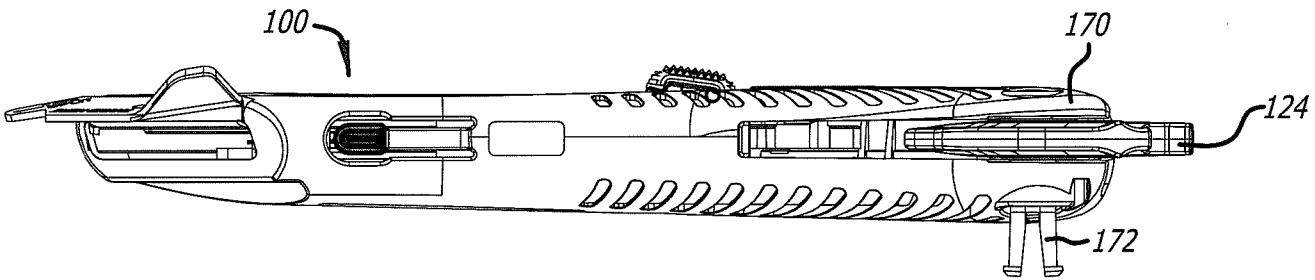
Figure 21A:
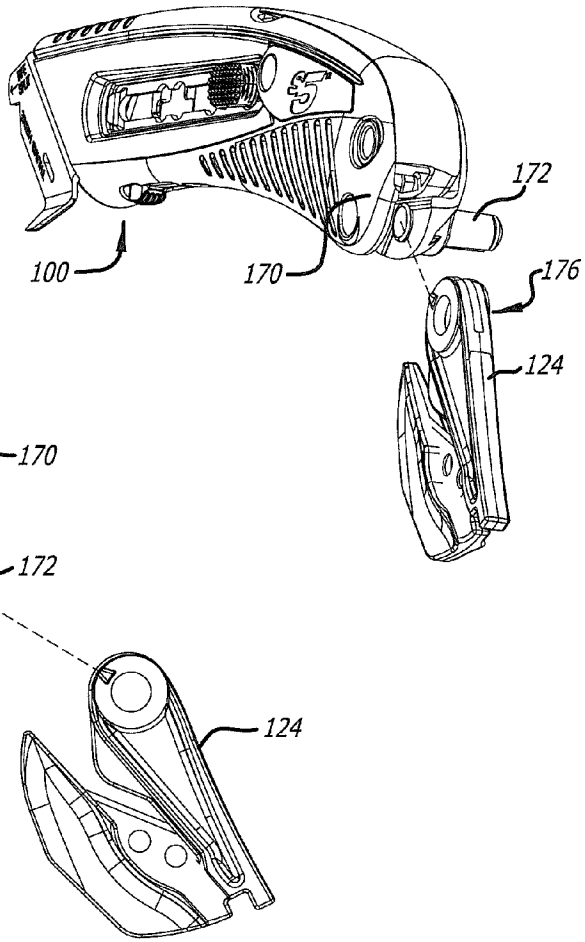
FIGS. 21A-21D are perspective, front, bottom, and right side views, respectively, of the example safety cutter with the film cutter separated from the housing.
Figure 21B:
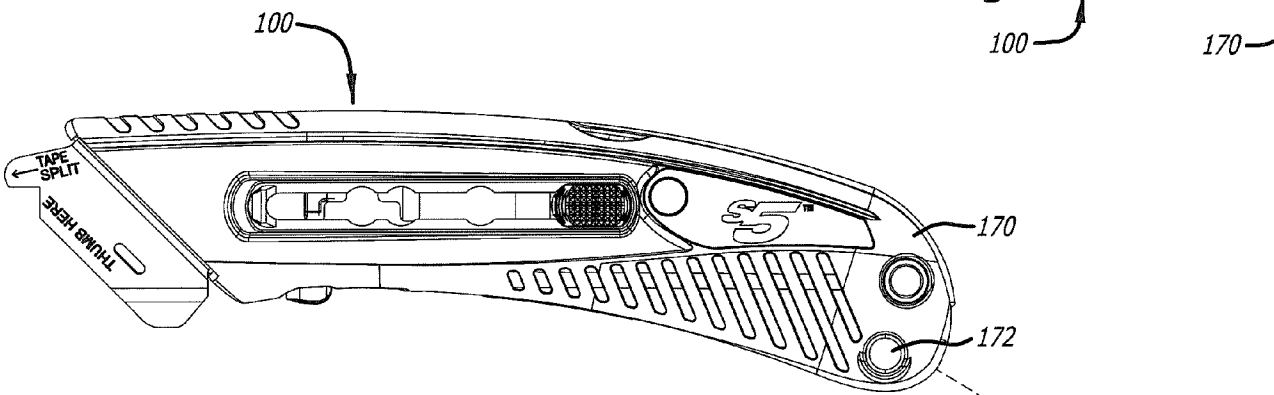
Figure 21D:
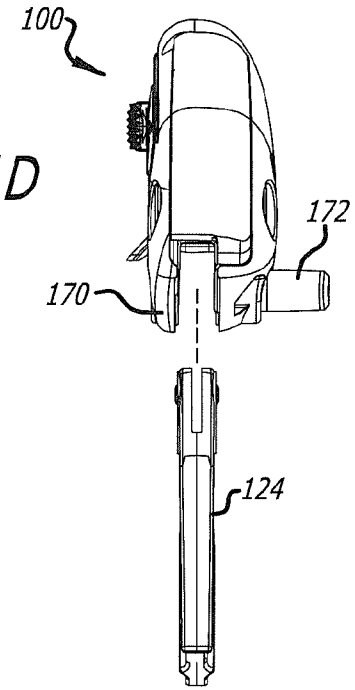
Figure 21C:
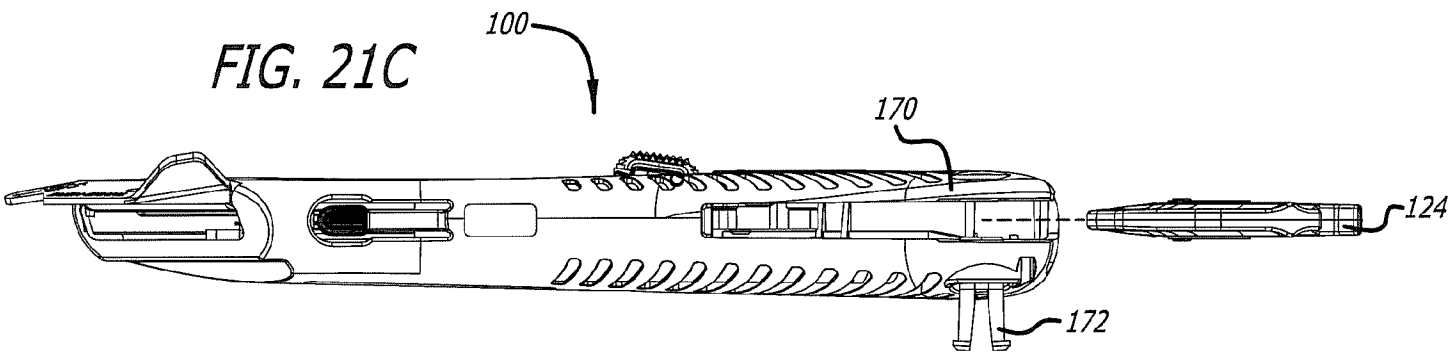

In summary, FIG. 15 shows the button 112 locked in its depressed position (i.e., film cutter mode), with the film cutter 124 being returned to its stored position in order to release the button 112 (to exit the film cutter mode). FIG. 16 shows the button 112 after it has "popped up" (i.e., released from the locked depressed position) as a consequence of the film cutter 124 being pushed back into the housing 102, thereby exiting from film cutter mode.

Thus, in an example embodiment, a cutter apparatus includes a housing, multiple tools mechanically coupled to the housing, at least one of the tools including a cutting device, and a slider and lock wheel mechanically coupled to the housing and configured to selectively release only one of the tools at a time from being secured within the housing by the lock wheel.

Referring to FIGS. 20A-22C, in this example embodiment, the film cutter 124 is detachably secured to a base portion 170 of the housing 102. In this example embodiment, the cutter apparatus 100 includes a retainer pin 172 which mechanically couples the film cutter 124 to the housing 102. In FIGS. 20A-20D, the retaining pin 172 is shown partially withdrawn from the housing 102. In FIGS. 21A-21D, the film cutter 124 is shown separated from the housing 102.

Referring to FIGS. 22A-22C, in this example embodiment, the retainer pin 172 includes a chamfered end portion 174. In this example embodiment, the retainer pin 172 and housing 102 are configured to permit the retainer pin 172 to be partially withdrawn from the housing 102 such that the chamfered end portion 174 is pre-aligned to detent with a base portion 176 (FIG. 21A) of the film cutter 124. In this example embodiment, the retainer pin 172 and the housing 102 include complementary surfaces 178 and 180 (FIG. 22C), respectively, which serve as a stop to limit how far the retainer pin 172 can be withdrawn from the housing 102.

In FIG. 22B, the retaining pin 172 is shown in a position for retaining the film cutter 124. In FIG. 22C, the retaining pin 172 is shown in a position for releasing the film cutter 124, which is also a position for reseating (detenting) with a film cutter 124 as discussed above.

Thus, in an example embodiment, a cutter apparatus includes a housing and multiple tools mechanically coupled to the housing, at least one of the tools including a film cutter that is detachably secured to the housing.

Although the present invention has been described in terms of the example embodiments above, numerous modifications and/or additions to the above-described embodiments would be readily apparent to one skilled in the art. It is intended that the scope of the present invention extend to all such modifications and/or additions.

What is claimed is:

1. A cutter apparatus comprising:

a housing;

multiple tools mechanically coupled to the housing, at least one of the tools including a cutting device; and a slider and lock wheel mechanically coupled to the housing and configured to selectively release only one of the tools at a time from being secured within the housing, the slider including a button that extends through the housing, the lock wheel including an aperture, and the button including a hook member configured to fit within the aperture;

wherein the aperture includes a button pop up ramp;

wherein the lock wheel includes a cutting device deployment member that is shaped such that when the cutting device is folded back into the housing the lock wheel is repositioned within the housing bringing the button pop up ramp into contact with the hook member to force the button to pop up and out of the aperture.

2. The cutter apparatus of claim 1, wherein the deployment member causes the cutting device to extend slightly from the housing when the lock wheel is repositioned to a cutting device release position.

3. The cutter apparatus of claim 1, wherein the lock wheel is pivotally coupled to the housing.

4. The cutter apparatus of claim 1, wherein:

the aperture includes a cam surface with a changeover point; and the hook member and cam surface are shaped such that the lock wheel is repositioned within the housing toward a cutting device release position when the hook member is pushed into the aperture and past the changeover point.

5. The cutter apparatus of claim 1, wherein the deployment member is brought into contact with the cutting device when the lock wheel is repositioned to a cutting device release position.

6. The cutter apparatus of claim 4, wherein the cam surface is shaped such that the lock wheel is repositioned within the housing toward a cutting device lock position when the hook member is pulled back from before the changeover point toward a button entry portion of the aperture.

7. The cutter apparatus of claim 1, wherein the cutting device is a film cutter.

8. The cutter apparatus of claim 1, further including:

a spare blade carrier which is mechanically coupled to the housing, and which is adjacent to the cutting device when both the spare blade carrier and the cutting device are positioned within the housing.

9. The cutter apparatus of claim 8, wherein the spare blade carrier is pivotally coupled to the housing.

10. The cutter apparatus of claim 8, wherein the housing includes a spare blade viewing hole which faces a portion of the housing adjacent to the end of the spare blade carrier when the spare blade carrier is positioned within the housing.

11. The cutter apparatus of claim 1, wherein the cutting device is detachably secured to a base portion of the housing.

12. The cutter apparatus of claim 1, wherein the cutting device is pivotally coupled to the housing.

13. The cutter apparatus of claim 1, wherein the cutting device is mechanically coupled to the housing such that the cutting device is manipulable to an extended position in which a cutting edge of the cutting device faces a bottom side of the housing.

14. The cutter apparatus of claim 1, further including:

a retainer pin which mechanically couples the cutting device to the housing.

15. The cutter apparatus of claim 14, wherein the retainer pin includes a chamfered end portion.

16. The cutter apparatus of claim 15, wherein the retainer pin and housing are configured to permit the retainer pin to be partially withdrawn from the housing such that the chamfered end portion is pre-aligned to detent with a base portion of the cutting device.

17. The cutter apparatus of claim 16, wherein the retainer pin and the housing include complementary surfaces which serve as a stop to limit how far the retainer pin can be withdrawn from the housing.

18. The cutter apparatus of claim 1, wherein the lock wheel is repositionable by a user of the cutter apparatus to selectively release only one of the tools at a time from being secured within the housing.

19. The cutter apparatus of claim 1, wherein the button engages and interlocks with the lock wheel when the button is used to release the cutting device.

20. A cutter apparatus comprising:

a housing;

multiple tools mechanically coupled to the housing, at least one of the tools including a cutting device; and a slider and lock wheel mechanically coupled to the housing and configured to selectively release only one of the tools at a time from being secured within the housing, the slider including a button that extends through the housing, the lock wheel including an aperture, and the button including a hook member configured to fit within the aperture;

wherein the aperture includes a cam surface with a changeover point and a button pop up ramp;

wherein the hook member and cam surface are shaped such that the lock wheel is repositioned within the housing toward a cutting device release position when the hook member is pushed into the aperture and past the changeover point;

wherein the lock wheel includes a cutting device deployment member which is brought into contact with the cutting device when the lock wheel is repositioned to the cutting device release position;

wherein the cutting device deployment member is shaped such that when the cutting device is folded back into the housing the lock wheel is repositioned within the housing bringing the button pop up ramp into contact with the hook member to force the button to pop up and out of the aperture.

21. The cutter apparatus of claim 20, wherein the cutting device is a film cutter.

22. A cutter apparatus comprising:

a housing;

multiple tools mechanically coupled to the housing, at least one of the tools including a cutting device; and a slider and lock wheel mechanically coupled to the housing and configured to selectively release only one of the tools at a time from being secured within the housing, the slider including button that extends through the housing, the lock wheel including an aperture, and the button including a hook member configured to fit within the aperture;

wherein the lock wheel includes a deployment member which causes the cutting device to extend slightly from the housing when the lock wheel is repositioned to a cutting device release position;

wherein the aperture includes a button pop up ramp;

wherein the cutting device deployment member is shaped such that when the cutting device is folded back into the housing the lock wheel is repositioned within the housing bringing the button pop up ramp into contact with the hook member to force the button to pop up and out of the aperture.

* * * * *